US008512105B2

(12) United States Patent
Smith

(10) Patent No.: US 8,512,105 B2
(45) **Date of Patent: *Aug. 20, 2013**

(54) ABRASIVE SHARPENER

(75) Inventor: Richard S. Smith, Hot Springs, AR (US)

(73) Assignee: Smith's Consumer Products, Inc., Hot Springs, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/542,327

(22) Filed: Jul. 5, 2012

(65) Prior Publication Data

US 2012/0270481 A1 Oct. 25, 2012

Related U.S. Application Data

(63) Continuation of application No. 12/005,207, filed on Dec. 26, 2007, now Pat. No. 8,221,199.

(60) Provisional application No. 60/879,832, filed on Jan. 11, 2007.

(51) Int. Cl.
*B23F 21/00* (2006.01)

(52) U.S. Cl.
USPC ..... 451/461; 451/462; 451/552; 451/555; 451/557; 451/558

(58) Field of Classification Search
USPC ..... 451/461, 462, 540, 552, 553, 555, 451/557, 558
See application file for complete search history.

(56) References Cited

U.S. PATENT DOCUMENTS

| | | | | | |
|---|---|---|---|---|---|
| 899,213 | A * | 9/1908 | Fitzgerald | 451/555 |
| 2,994,234 | A * | 8/1961 | Lizak | 76/86 |
| D241,504 | S * | 9/1976 | Krusche et al. | D8/93 |
| 4,494,340 | A * | 1/1985 | Carter | 451/555 |
| 4,696,129 | A * | 9/1987 | Roberts | 451/555 |
| 4,823,498 | A * | 4/1989 | Banta | 43/25 |
| 5,377,563 | A * | 1/1995 | Weeks | 76/86 |
| 5,438,757 | A * | 8/1995 | Weschenfelder | 30/139 |
| D375,241 | S * | 11/1996 | Pigott | D8/93 |
| 5,782,681 | A * | 7/1998 | Bresnahan | 451/523 |
| D404,278 | S * | 1/1999 | Gore | D8/93 |
| 6,039,642 | A * | 3/2000 | Collins | 451/557 |
| 6,059,645 | A * | 5/2000 | LeVine | 451/557 |
| 6,101,898 | A * | 8/2000 | Gore et al. | 76/82 |
| 6,949,018 | B2 * | 9/2005 | Bleier | 451/461 |
| D526,876 | S * | 8/2006 | Smith | D8/93 |
| D604,135 | S * | 11/2009 | Smith et al. | D8/63 |
| 7,927,185 | B2 * | 4/2011 | Vandamme et al. | 451/9 |
| 7,930,058 | B2 * | 4/2011 | Bhagavat et al. | 700/164 |
| 2005/0221742 | A1 * | 10/2005 | Su | 451/555 |
| 2006/0111030 | A1 * | 5/2006 | Harden et al. | 451/523 |
| 2006/0211346 | A1 * | 9/2006 | Morita et al. | 451/349 |
| 2008/0039001 | A1 * | 2/2008 | Evans | 451/558 |

* cited by examiner

*Primary Examiner* — Eileen P. Morgan

(74) *Attorney, Agent, or Firm* — Edward D. Gilhooly

(57) ABSTRACT

A pocket abrasive sharpener having a housing formed with a pair of upper slots and a lower open compartment. A pair of abrasive ceramic stones is mounted in one of the slots to form a V-shaped sharpening edge. Each ceramic stone has at least one flat face to abut an adjacent reversed stone to form the V-shaped sharpening slot. The stone has an abrasive cutting edge formed with a radius for sharpening serrated edges and having abrasives surfaces on both sides of the radius. A pair of abrasive blades having V-shaped carbide cutting edges is mounted in the other of the slots to also form a V-shaped sharpening slot. A tapered abrasive of is pivotally mounted on the housing and is moveable from the compartment to an extended position for sharpening knives and removing pins in certain military and civilian rifles.

6 Claims, 5 Drawing Sheets

ABRASIVE SHARPENER

This application is a continuation of application Ser. No. 12/005,207 filed Dec. 26, 2007, now U.S. Pat. No. 8,221,199 issued Jul. 17, 2012, and claims benefit of the priority date of provisional application, Ser. No. 60/879,832 filed Jan. 11, 2007.

BACKGROUND OF THE INVENTION

1. Field of the Invention

This invention relates in general to abrasive sharpeners and, more particularly, to a hand held, abrasive sharpener.

2. Summary of the Prior Art

Numerous designs for portable abrasive sharpeners for serrated and straight edge knives and the like are known in the prior art. Some of the designs for hand held sharpeners have employed more than one sharpening capability. Such known designs, however, have not combined multiple abrasive sharpening elements in a small, hand held sharpener that can be readily transported and can produce highly effective sharpening results, whether to sharpen a straight edge or a serrated edge. In the past, opposed circular ceramic rods have been used in sharpeners. Because of the configuration the opposed abrasive surfaces are relatively spaced in a lateral direction. As a result of the foregoing spacing, serrated edges are not optimally sharpened. Accordingly, it is desirable in the prior art to provide an improved compact and economical abrasive device having multiple different abrasive elements and being capable of being portably transported in the pocket and the like of an individual.

SUMMARY OF THE INVENTION

It is therefore an objective of this invention to provide an improved compact abrasive sharpener for knives and the like having multiple abrasive elements to sharpen a large variety of knives or other implements and a tool in field gun breakdown for civilian and military rifles for cleaning. The abrasive elements herein disclosed may be used to sharpen a large range of different knife designs, whether having straight or serrated edges and the like. The sharpener of the invention is easily transported by an individual from place to place and is hand held during a sharpening operation. At one abrasive station, the sharpener employs a pair of opposed blades at an upper slot, economically fabricated from steel and having carbide insert for economy of manufacture. Alternatively, the opposed blades can be constructed entirely from carbide. At a second abrasive station on the housing of the invention, a pair of a specialty shaped triangular ceramic stones having a flat shape are mounted in a juxtaposed relationship forming sloped opposed sharpening edges. The opposed edges of the pair of ceramic stones provide a generally continuous opposed sharpening edges for greater effectiveness in sharpening edges. The opposed overlapping ceramic stones are capable of sharpening both sides of the edge of a knife nearly simultaneously. The sharpening edges are further curved to provide better sharpening of serrated edges. Both the carbide blades and the ceramic stones have abrasive surfaces can be removed and reversed and both are capable of sharpening blades by bi-directional movement. A tapered abrasive rod is pivotally mounted on the body of the sharpener and is manually movable from a stowed position within the sharpener to an external extended position for use as a sharpening element or as a tool to remove pins from certain rifles for cleaning. The extended rod creates a free tip serving as a punch for manually dislodging pins from a military or civilian rifle for disassembly for cleaning the rifle in a technique well known in the art. The sharpener of the invention is economical to manufacture and is effective in use.

DESCRIPTION OF THE PREFERRED EMBODIMENT

Figure 1:
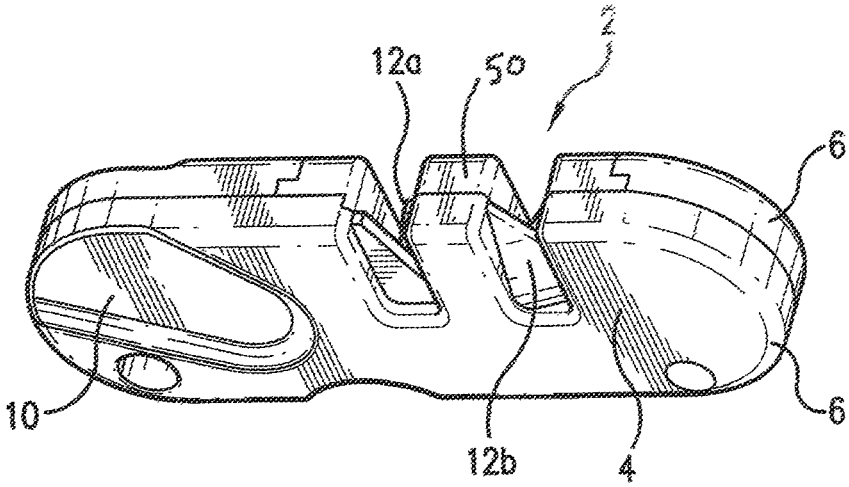
FIG. 1 is a back perspective view of the pocket abrasive sharpener of the invention.
Figure 2:
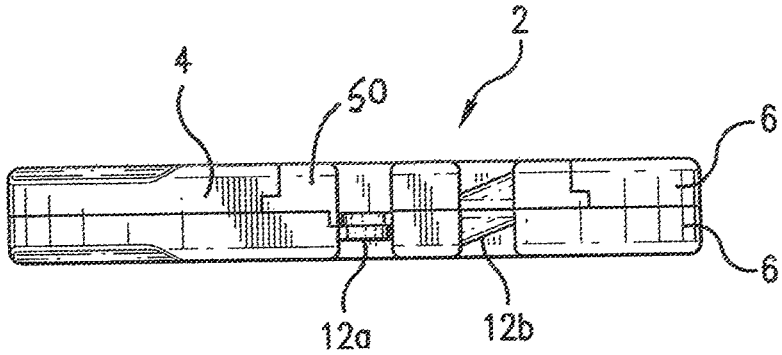
FIG. 2 is a top plan view of the pocket abrasive sharpener of FIG. 1.

Referring now to FIGS. 1-6, there is illustrated the abrasive sharpener of the invention, generally designated by reference numeral 2. The pocket sharpener 2 has a body 4 formed by a pair of contacting body halves 6. The pair of halves 6 may be fabricated from a suitable plastic and are retained together to body 4 by an adhesive, welding, and the like and by a mechanical fastener received in hole 8*a*. A lanyard hole 8*b* is provided at the other end of housing 4. A recessed thumb depression 10 is formed on both of the body halves 6 at one end to form an area to allow the user to more firmly grip the sharpener during a sharpening task. A pair of lateral, side by side slots 12*a*, 12*b*, providing a pair of sharpening stations, are formed on the top of the body 4 to respectively receive overlapping offset flat blades having carbide abrasive edges and flat ceramic stones to be described later.

The bottom 20 of the sharpener body is open and forms a storage compartment 22 to receive abrasive rod 24 that extends upward to an abutment wall 6*a* formed by body halves 6. The abrasive rod 24 is tapered and is formed as a one piece member having a circular cross sectional shape generally along its length. The enlarged end of the rod 24 includes circular pivot member 24*a* and integral hollow plastic projection 24*b* to receive and mount the rod 24. A hole 26 on pivot member (not shown) receives a mechanical fastener in hole 8*a*. The rod 24 is formed from a metal material, such as steel, aluminum, and the like. Multiple layers of an abrasive grit, such as diamonds or other suitable abrasives, are provided on substantially all of the surface 24*a*' on the cylindrical tapered external surface and in the slot of the tapered rod 24 to attain sharp edges on a large number of implements to be sharpened after pivoting the tapered rod from storage in compartment 22 to an extended outward position in phantom as shown in FIG.

5. Access to the tapered rod 24 in body 4 is provided by lower cut-out areas 28 on both sides of the sharpener 2. Upon performing a sharpening task in its external position, the tapered rod 24 can easily be swung back into compartment 22 for storage. The tapered rod 24 may be used to sharpen both serrated and straight edges of knives and the like. The generally flat tip 25 of the tapered abrasive rod 24 is designed to be a pin punch for manual disassembly of certain rifles (not shown) for cleaning and the like. A respective pair of retention protrusions 22*a*, 22*b* is provided on the walls of storage compartment 22 at a first position above integral projection 24*b* when the rod 24 is disposed in the storage compartment and at a second position below the projection 24*b* when the rod 24 is fully pivoted for sharpening function. The respective pairs of protrusions 22*a*, 22*b* are spaced apart by a distance smaller than the diameter of projection 24*b* so that the projection snaps through the respective pair of protrusions 22*a* and 22*b* into the first storage position or the second sharpening position when the plastic projection 24 moves through a respective pair of protrusions which bias the projection 24*b* against adjacent of the body 4 for a rigid securement of the rod. The low friction plastic projection 24*b* reduces wear on the protrusions 22*a*, 22*b*. The protrusions 22*a*, 22*b* thus serve as retention elements in both the first and second position and either retains the rod 24 firmly in the storage position and in the extended position.

Figure 3:
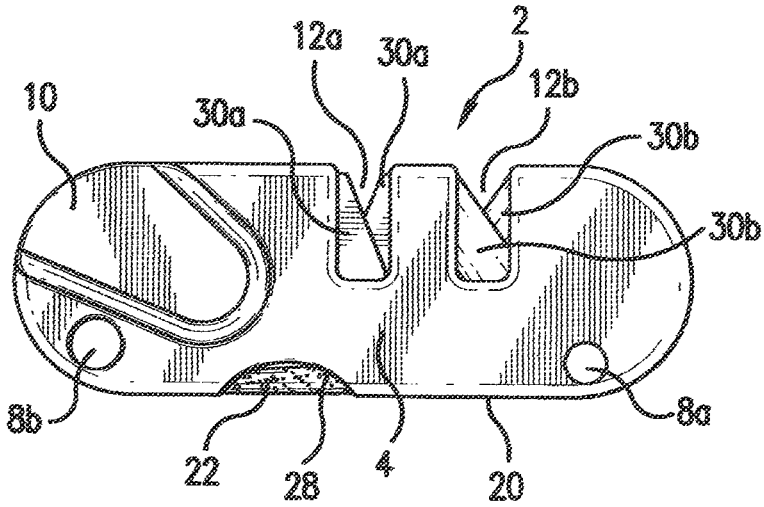
FIG. 3 is a back elevational view of the pocket abrasive sharpener of FIG. 1.
Figure 4:
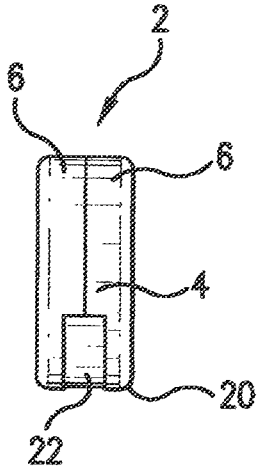
FIG. 4 is an end elevational view of the pocket abrasive sharpener of FIG. 1
Figure 5:
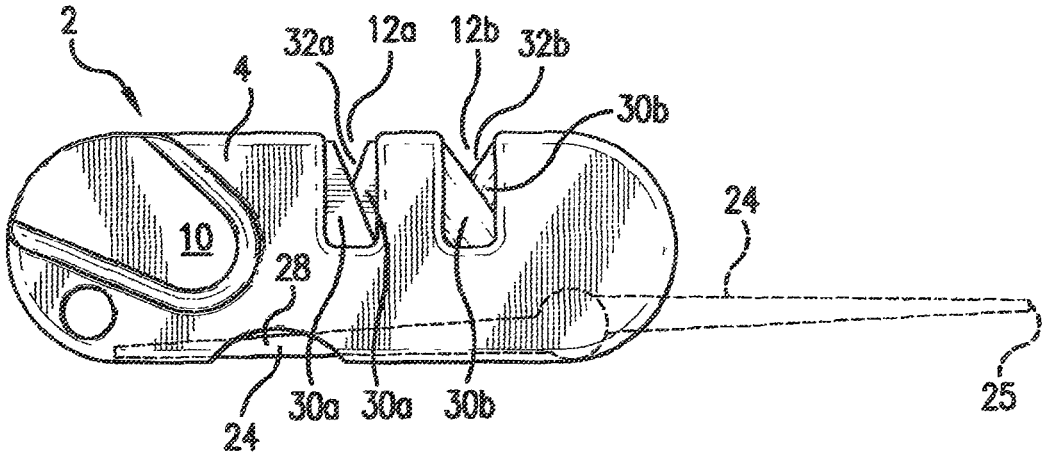
FIG. 5 is a front elevational view of the pocket abrasive sharpener of FIG. 1 having a pivoted abrasive rod capable of being extended.
Figure 6:
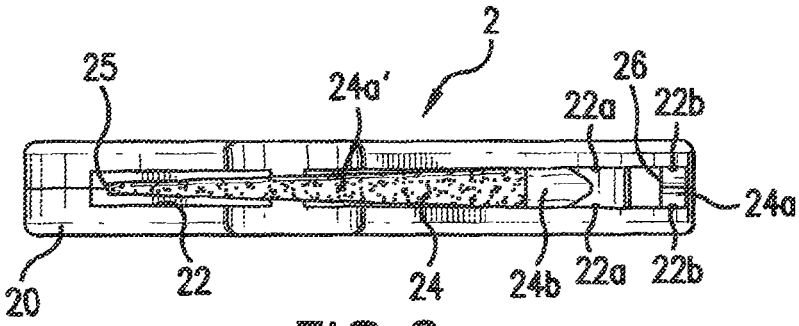
FIG. 6 is a bottom plan view of the pocket abrasive sharpener of FIG. 5.
Figure 7:
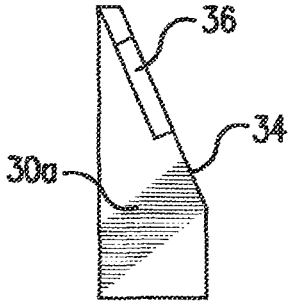
FIG. 7 is a side elevational view of an abrasive blade having carbide insert.
Figure 8:
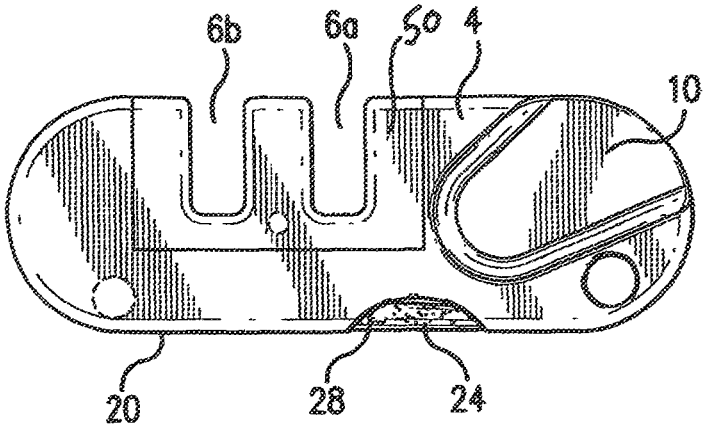
FIG. 8 is a front elevational view of the pocket sharpener of FIG. 1.

As seen in FIGS. 1, 3 and 5, a pair of abrasive blades 30*a* and a pair of offset ceramic stones 30*b* are respectively clamped together in upper slots 12*a* and 12*b* to form respective generally V-shaped sharpening areas 32*a* and 32*b* accessible from the top of body 4. The blades 30*a* are a pair of flat members having a substantial rectangular configuration having a beveled sharpening edge 34 as shown in FIG. 7 to create the V-shaped sharpening area 32*a* between the blades by the beveled edges 34 of the adjacent blades 32*a* being opposed to each other. In a technique to economize the cost of manufacture, the blades 32*a* are formed of less expensive material such as steel and includes carbide insert 36 to form beveled sharpening edge 34 mounted in the blade 30*a* and being exposed on beveled edge 34 to provide an abrasive sharpening surface in the V-shaped sharpening area 32*a*. It is within the scope of the invention to construct the blades 30*a* entirely out of carbide. The carbide sharpening edge 34 is ground flat on two sides to create a sharp 90° edge with abrasive carbide surfaces on the two sides for better sharpening consistency from both sides of the blades for bi-directional sharpening and for the capability of sharpening both sides of the knife edge at the same time. In the prior art a blade is only capable of being sharpened through one directional movement by carbide blades.

The pair of stones 30*b* (FIGS. 3, 5, 9, and 10) are flat ceramic abrasive members generally having a body having a plurality of side portions 31*a*, 31*b* and 31*c* forming a triangular cross-sectional configuration with a sharpening edge portion 31*c*'. The pair of stones 30*b* are clamped in juxtaposition in overlapping contacting relationship to provide V-shaped sharpening area 32*b* in slot 12*b*, which is capable of sharpening both sides of a knife edge at the same time. It is within the scope of the invention to form the stones 30*b* with shapes other than the triangular configuration disclosed herein to achieve the objective of the invention of providing a pair of ceramic stones having cutting edges capable of sharpening both sides of the knife edge at generally the same time, while providing sufficient structural support of the abrasive cutting edges to sustain sharpening operations. The stones 30*b* further respectively include opposed flat faces 40 lying in a plane generally perpendicular to the plane of said plurality of side portions 31*a*, 31*b*, and 31*c* whereby the flat face 40 of one stone 30*b* contacts the flat face 40 of the adjacent stone 30*b* to situate the two abrasive edges 42 formed on edge portions 31*c*' of the contacting stones 30*b* with virtually no lateral spacing between them such as exists in prior art crossed circular ceramic rods. This close relationship with little spacing between the pair of abrasive edges 42 forming V-shaped area 32*b* provides for more effective sharpening. To increase this effectiveness, such as, for example, for sharpening knives having serrated edges, the abrasive edges 42 are formed with a slight curved radius 42*a* in cross-section generally along their width. It is within the scope of the invention to mount the blades 30*a* and the stones 30*b* alternatively in either of the slots 12*a* or 12*b*. Both the blades 30*a* and stones 30*b* are removable as will be described for replacement or to reverse the respective pairs of blades and/or stones.

Figure 9:
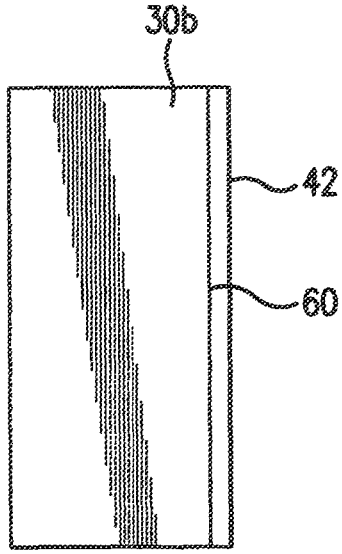
FIG. 9 is a front elevational view of the ceramic stone of the abrasive sharpener of FIG. 1.
Figure 10:
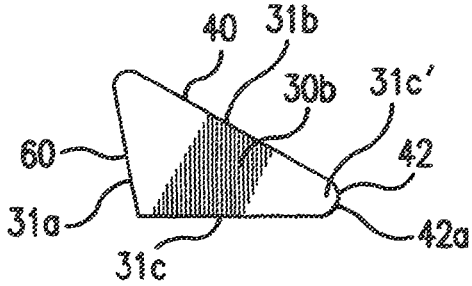
FIG. 10 is a side elevational view of the ceramic stone of FIG. 9.
Figure 11:
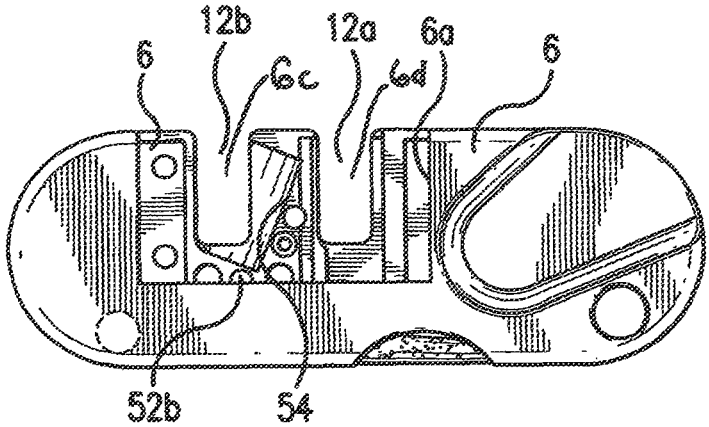
FIG. 11 is a front elevational view of the body sharpener with retention member removed.
Figure 12:
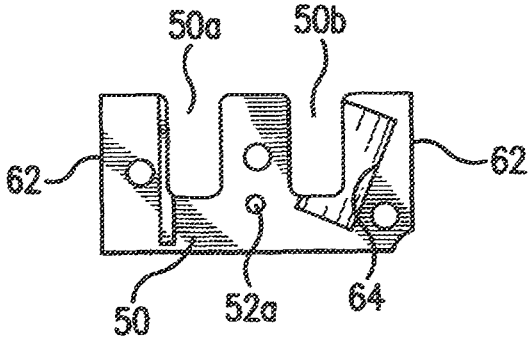
FIG. 12 is a back elevational view of the retention member of the pocket abrasive sharpener of FIG. 1.

Referring now to FIGS. 3, 5, 8, 11, and 12, the mounting of the blades 30*a* and stones 30*b* is best shown. A retention member 50 is removeably mounted on the front body half 6. A screw (not shown) through 52*a*, 52*b* secures the retention member 50 to a portion of the rear body half 6. Upon removal of the screw, the retention member 50 may be lifted upward from body 4. As seen in FIG. 11 with the retention member 50 removed, the front wall half 6 is cut out in a shape 6*a* corresponding to the configuration of the retention member 50. The rear body half 6 is formed with a pair of slots 6*c*, 6*d* as shown FIG. 12. A sloped shoulder 54 is formed on rear body half 6 to support a surface 60 (FIGS. 9 and 10) of one of the pairs of ceramic stones 30*b*. As seen in FIG. 9 the retention member 50 is substantially a flat member having slots of 50*a* and 50*b*, which, when mounted on body 4, are aligned with slots 12*a*, 12*b*. The retention member 50 further includes outward narrow edges 62 to slide into retention slots (not shown) in the front body half 6. A sloped shoulder 64 is formed adjacent to slot 12*b* to contact with the surface 60 of the second of the pairs of ceramic stones 30*b*. Thus, when the retention member 50 is mounted, the carbide blades 30*a* and ceramic stones 30*b* are firmly clamped between the inner surfaces of the retention member 50 and the upper portion of rear body half 6.

What is claimed is:

1. An abrasive sharpener comprising a housing having at least one slot, a pair of abrasive elements being mounted in juxtaposition relationship in said at least one slot to form opposed abrasive surfaces for sharpening, said housing having an open compartment, an elongated abrasive rod having an end portion being pivotally mounted on a portion of said housing for movement between a stowed position within said compartment to an outward extended position for sharpening, said housing having a pair of spaced walls adjacent said open compartment, said spaced walls having at least one protrusion extending into said open compartment at a first position and creating a reduction in the width between said pair of spaced walls generally to contact said abrasive rod to retain said abrasive rod in said extended position for sharpening and permit selective movement of said abrasive rod between said extended position and said stowed position, and said spaced walls further having at least one protrusion extending into said open compartment at a second position and creating a reduction in the width between said pair of spaced walls generally to contact said abrasive rod to retain said abrasive rod in said stowed position within compartment and permit selective movement of said abrasive rod between said stowed position and said extended position.

2. The abrasive sharpener according to claim 1 wherein said at least one protrusion disposed at either said first position or said second position are a plurality of protrusions extending into said compartment.

3. The abrasive sharpener according to claim 2 wherein said abrasive rod is tapered.

4. The abrasive sharpener according to claim 1 wherein said abrasive rod has respective cross-sections of predetermined widths adjacent said at least one protrusion at said first position and said second position, said at least one protrusion at said first position and second position extend into said compartment and reduce the width of said compartment generally by a distance less than said respective predetermined widths of said abrasive rod for respectively retaining said abrasive rod within said compartment and for retaining said abrasive rod in said extended position.

5. The abrasive sharpener according to claim 1 wherein said rod has a low friction surface for contacting said at least one protrusion at said first position and said second position during said movement between said stowed position and said extended position.

6. An abrasive sharpener comprising a housing having at least one slot, a pair of abrasive elements being mounted in a juxtaposition relationship in said at least one slot to provide generally V-shaped opposed abrasive surfaces for sharpening, said housing having an open bottom compartment, an elongated abrasive rod being pivotally mounted on a lower portion of said housing for movement between a stowed position within said housing to an outward extended position for sharpening, said housing having a pair of spaced walls adjacent said open bottom compartment, said spaced walls respectively having a plurality of protrusions extending into said compartment in a spaced relationship to each other within said compartment, said elongated rod having a generally circular cross-section of a predetermined diameter adjacent said protrusions, and some of said plurality of protrusions being spaced by a distance less than said predetermined diameter of said abrasive rod for retaining said abrasive rod in said extended position and permitting movement through said some of said plurality of protrusions when said abrasive rod is pivoted to said extended position, and other of said plurality of protrusions being spaced by a distance less than said predetermined diameter of said abrasive rod for retaining said abrasive rod in said stowed position and permitting movement through said other of said plurality of protrusions when said abrasive rod is pivoted to said extended position.

* * * * *